US011840384B2

(12) United States Patent
Simakovsky

(10) Patent No.: US 11,840,384 B2
(45) Date of Patent: Dec. 12, 2023

(54) CONTAINER CLOSURE SYSTEM

(71) Applicant: Alexander J. Simakovsky, Weehawken, NJ (US)

(72) Inventor: Alexander J. Simakovsky, Weehawken, NJ (US)

( * ) Notice: Subject to any disclaimer, the term of this patent is extended or adjusted under 35 U.S.C. 154(b) by 0 days.

(21) Appl. No.: 17/744,639

(22) Filed: May 14, 2022

(65) Prior Publication Data

US 2023/0365310 A1 Nov. 16, 2023

(51) Int. Cl.

| | |
|---|---|
| ***B65D 51/32*** | (2006.01) |
| ***B65D 43/02*** | (2006.01) |
| ***B65D 51/18*** | (2006.01) |
| ***B65D 51/08*** | (2006.01) |

(52) U.S. Cl.

CPC ..... *B65D 51/32* (2013.01); *B65D 43/0212* (2013.01); *B65D 51/08* (2013.01); *B65D 2251/0012* (2013.01); *B65D 2251/0081* (2013.01); *B65D 2543/00046* (2013.01); *B65D 2543/00092* (2013.01); *B65D 2543/00731* (2013.01); *B65D 2543/00796* (2013.01)

(58) Field of Classification Search

CPC .... B65D 51/32; B65D 43/0212; B65D 51/18; B65D 2251/0012; B65D 2251/0081; B65D 2543/00046; B65D 2543/00092; B65D 2543/00731; B65D 2543/00796

USPC ..... 220/212, 284, 713; 215/302, 305; D9/436

See application file for complete search history.

(56) References Cited

U.S. PATENT DOCUMENTS

| | | | | |
|---|---|---|---|---|
| 4,589,569 | A | 5/1986 | Clements | |
| 4,738,373 | A | 4/1988 | DeParales | |
| 4,782,975 | A | 11/1988 | Coy | |
| 5,143,248 | A | 9/1992 | Sawatsky | |
| 5,979,689 | A | 11/1999 | Lansky | |
| 6,199,711 | B1 | 3/2001 | Lansky | |
| 6,209,748 | B1 * | 4/2001 | Dunbar | B65D 51/24 220/521 |
| 6,305,571 | B1 | 10/2001 | Chu | |
| 6,311,863 | B1 | 11/2001 | Fleming | |
| 6,578,726 | B1 | 6/2003 | Schaefer | |
| 6,679,397 | B2 | 1/2004 | Smith et al. | |
| 6,732,875 | B2 | 5/2004 | Smith et al. | |
| 6,889,859 | B1 | 5/2005 | Leon | |
| 7,063,224 | B2 | 6/2006 | Clarke et al. | |
| 7,100,790 | B2 | 9/2006 | Dark | |
| 7,131,551 | B2 | 11/2006 | Smith | |

(Continued)

FOREIGN PATENT DOCUMENTS

| | | | | |
|---|---|---|---|---|
| GB | 2541045 A * | 2/2017 | | B65D 51/32 |
| JP | 2011136749 A * | 7/2011 | | |

(Continued)

*Primary Examiner* — James N Smalley

(74) *Attorney, Agent, or Firm* — Aaron L. J. Pereira

(57) ABSTRACT

A container closure system comprising a container (e.g., a coffee cup) with a lid comprising a sip hole, wherein the closure system further comprises a stirrer that may be used to removably plug the sip hole in the lid, said stirrer being optionally further capable of stirring liquid within the container. The present invention also may include an attachment mechanism or attachment means on or adjacent to the lid, whereby the stirrer may by releasably attached to the lid for storage, transportation, and to facilitate facile relocation of the stirrer.

19 Claims, 5 Drawing Sheets

(56) References Cited

U.S. PATENT DOCUMENTS

| | | | | |
|---|---|---|---|---|
| 7,134,566 | B2 | 11/2006 | Smith et al. | |
| 7,156,251 | B2 | 1/2007 | Smith et al. | |
| 7,437,900 | B1 | 10/2008 | Slone | |
| 8,172,452 | B2 | 5/2012 | Bacon et al. | |
| 8,322,548 | B2 * | 12/2012 | Pedersen | B65D 41/0485 215/218 |
| 8,794,822 | B2 | 8/2014 | Serra | |
| 8,950,623 | B2 | 2/2015 | Fleming | |
| D732,956 | S * | 6/2015 | Brown | D9/447 |
| D735,577 | S * | 8/2015 | Lee | D9/452 |
| 9,751,665 | B2 | 9/2017 | Fleming | |
| 2006/0180593 | A1 * | 8/2006 | White | A47G 21/182 220/705 |
| 2007/0095833 | A1 * | 5/2007 | Burns | B65D 51/18 220/793 |
| 2008/0073342 | A1 * | 3/2008 | Cai | B65D 47/286 220/780 |
| 2016/0065705 | A1 * | 3/2016 | Nam | B65D 51/24 455/575.8 |
| 2019/0367231 | A1 | 12/2019 | Riffel | |
| 2020/0324947 | A1 * | 10/2020 | Cunningham | B01F 33/86 |
| 2021/0228006 | A1 * | 7/2021 | Curry | B65D 51/248 |

FOREIGN PATENT DOCUMENTS

| | | | | |
|---|---|---|---|---|
| JP | 2013126882 | A | * | 6/2013 |
| KR | 2014013823 | A | * | 2/2014 |
| KR | 2004074817 | A | * | 10/2014 |

* cited by examiner

CONTAINER CLOSURE SYSTEM

BACKGROUND

The present invention relates to novel and inventive advancements associated with container closure systems such as beverage containers and lids therefor that include integrated stirrers removably attachable to the lid or container, wherein the stirrer can be attached to the lid or container or used to plug a sip hole in the cup or lid, and substantially prevent the flow of fluid or liquid through a sip hole present in the lid or container. In some embodiments, the stirrer is fully removable from the lid and/or container. The present invention may include means for coupling one or more of the aforementioned elements of the container closure system to one another, including means for coupling, operatively coupling, releasably coupling, and/or detachably attaching the stirrer to the lid or container.

To the extent that any statement herein refers to anything other than the present disclosure and/or present invention, such statements are merely descriptive of the background and field of the invention and are not admissions that anything is prior art to the present invention. To the extent that the inventor characterizes anything that came before the present invention, such characterization is made through the unique lens of the inventor and may include knowledge of the present invention, such that any characterization of alleged prior art is not an admission that any feature was taught in the prior art or is or is not present in the inventor's disclosure.

Numerous container closure systems are known and/or currently in use in the beverage industry, including for holding and dispensing hot beverages such as coffee, tea, or soups. As can be readily appreciated, such containers and container closure systems can readily be used for other liquids, fluids, or even solids, without departing from the essential character or structure. Following are some examples of container closure systems. The present disclosure incorporates by reference the features of these and other known container closure systems, and the inventive aspects of the present disclosure may be used with or adapted for use with any of these known container closure systems.

U.S. Pat. No. 4,589,569 relates a lid with a preformed opening for drinking through which the container liquid may be consumed, wherein the preformed opening is elevated above the rim of the beverage container. Some drawbacks of '569 patent include that it provides no spill resistance when the cup is tilted or turned on its side, and accelerates relative heat loss through a chimney effect through the elevated sip hole location.

In other container closure designs, U.S. Pat. No. 4,782,975 relates to an inner lid component that cooperates with the outer lid to provide a normally closed valve that opens via externally applied lip pressure. U.S. Pat. No. 5,143,248 discloses a complete inner lid layer cooperating with an outer lid, wherein the inner layer can be rotated relative to the outer layer to close the sip hole. U.S. Pat. Nos. 5,979,689 and 6,199,711 relate to disc layers that create a baffle flow layer for fluid flow, wherein either the outer lid layer or the inner lid layer wrap around and attach to the cup lip, or contain a series of flaps activated by a rotatable layer.

Similarly, U.S. Pat. No. 6,305,571 introduces an inner lid layer with some specifically located holes, allowing fluid to pass into a chamber directly under the sip hole and then returning the excess fluid down a ramp to a drain hole. U.S. Pat. No. 6,311,863 introduces an aroma baffle that claims to enhance the beverage drinking experience. U.S. Pat. No. 6,578,726 claims a one or two-piece construction, but without disclosing a method or drawing of a one-piece construction. The '726 patent claims that the lower lid portion may be used singularly in some applications without the second portion. U.S. Pat. No. 6,732,875 introduces a two-piece lid with the inner lid layer rotatable with respect to the outer lid layer via a finger tab or similar means. U.S. Pat. No. 7,156,251 is a variation on the theme of U.S. Pat. No. 6,732,875. Similarly, U.S. Pat. No. 7,100,790 introduces a single-piece lid with baffle openings that allow fluid to pass from the container into a reservoir on the other side of the lid.

Drawbacks of these systems include the requirement for expensive materials, cumbersome additional components, expensive manufacturing, and limited applicability to the single-use disposable product market. To the extent that any of these systems include components such as certain downward extending baffles, such components make the products not stackable and therefore difficult to ship and store. Additionally, several of the prior designs provide little to no spill or splash resistance. In designs that include a secondary lid portion connected to an inner lid portion, the lid portions may pop off unexpectedly, not be assembled properly, or leak around the perimeter.

U.S. Pat. No. 7,063,224 introduces a lid with a tab that tilts back and secures in place. A disadvantage of the '224 patent is that once the tab has been tilted back and secured, no additional splash or spill resistance is provided to the consumer. Similarly, U.S. Pat. No. 4,738,373 to DeParales discloses a container lid where the opening is formed after a hinged tear panel is removed from an outer edge of the lid. Due to its hinged construction, the tear panel can unexpectedly rotate back towards the edge while a user is drinking from the container, thereby interfering with the discharge of the container contents. In addition, it is quite difficult to completely re-seal the opening with the tear panel once it is initially removed from the edge of the container or lid.

There are systems that attempt to solve for the problem of the lid not being resealable after first use. For example, in one system as embodied in U.S. Pat. No. 6,679,397, a tethered closure tab can seal the sip hole during transport. U.S. Pat. Nos. 7,131,551 and 7,134,566 are variations on the theme of the U.S. Pat. No. 6,679,397 tethered tab closures. However, these container closure systems have several key disadvantages. The tethered closure tab system cannot be detached from the lid and container, and instead creates an awkward hanging or swaying portion that is also potentially unhygienically exposed to body surfaces. Moreover, significantly, the tethered closure tab cannot be used to stir the liquid inside the container. One disadvantage is that the consumer must re-install the closure tab between sips to gain the advantage of the closure tab, which is a two-hand function and awkward for many consumer drinking experiences, resulting is consumers not re-installing the closure tab. Another disadvantage of these tethered systems is that they are not stackable, resulting in excessive vendor cost for storage and shipping. The tethered tab dangles about the consumer, detracting from the beverage drinking experience.

Moreover, a key drawback to all of these prior closure systems is that the closure means has a single function and cannot be used to stir the liquid or for other operative functions that may require a device with some length.

One existing container closure system that is currently in use is the "splash stick," which is used by coffee purveyors like Starbucks to reseal the sip holes in disposable coffee cup lids. However, a significant disadvantage with splash sticks is that they are not attached or attachable to the coffee cups or lids, except when being actively used to plug the sip hole. Moreover, shorter splash sticks only accomplish a plugging function and cannot be used to stir the liquid inside the container.

There exists a need for a device or vessel that will prevent beverage splashing and/or spilling from disposable cup and lid combinations, while still allowing beverage retailers to retain the economical incentives associated with the use of more conventional stackable disposable lid designs. There exists the further need for a container with a closure system that effectively re-seals the sip hole of the container for various applications such as transportation. There also exists the need for a container lid that sufficiently attaches the closure device to the lid, and the additional need for the device to be detachably attached to the lid or container for efficient and effective transportation and drinking or dispensing of the contents of the container. There further exists the need for the sip hole closure device to have multiple uses, such as stirring the contents of the container for efficiency, ease of use, and economic viability. And in such cases, there exists the need for a lid with a closure device or stirrer that can be reliably secured, such that the stirrer does not interfere with the discharge of the container contents, but may also be reliably secured in a place that it can be found (i.e., on the lid or the container) when not in active use for plugging the sip hole.

The present invention satisfies these and other real and present needs. Those skilled in the art will appreciate that conventional cup and lid combinations may be utilized in the marketplace that incorporate one or more of the various features of the subject invention.

BRIEF SUMMARY OF THE INVENTION

Certain terminology is used in the following description for convenience only and is not limiting. Unless specifically set forth herein, the terms "a," "an," and "the" are not limited to one element but instead should be read as meaning "at least one." The words "right," "left," "lower," and "upper" designate directions in the drawings to which references are made. Similarly, the words "inwardly" or "distally" and "outwardly" or "proximally" refer to directions toward and away from, respectively. The words, "anterior," "posterior," "superior," "inferior," "lateral," and related words and/or phrases designate preferred positions, directions and/or orientations to which references are made and are not meant to be limiting. The terminology includes the above-listed words, derivatives thereof and words of similar import.

It should also be understood that the terms "about," "approximately," "generally," "substantially" and like terms, used herein when referring to a dimension or characteristic of a component of the preferred invention, indicate that the described dimension/characteristic is not a strict boundary or parameter, and does not exclude minor variations therefrom that are functionally the same or similar, as would be understood by one having ordinary skill in the art. At a minimum, such references that include a numerical parameter would include variations that, using mathematical and industrial principles accepted in the art (e.g., rounding, measurement, or other systematic errors, manufacturing tolerances, etc.), would not vary the least significant digit.

The present disclosure uses the term "cup" or "container" to refer generally to any container for use with or consistent with the present invention, including, for example, coffee cups, beverage cups, soup containers, and other containers with a detachable or substantially detachable and re-attachable lid. Similarly, the term "lid" is used in the present disclosure to refer generally to the container closure for use with such containers.

The "sip hole" is an opening in the lid through which a user may drink the contents—typically liquid contents—of the container. An example of such a sip hole is the typical opening provided in a coffee cup lid for drinking the contents of the coffee cup. Such a sip hole may be generally spherical, oval, an elongated oval, square, rectangular, or similarly shaped, and may be preferably located proximal to the circumferential perimeter of the lid. For example, the sip hole may be an elongated oval shape located along a raised ring-like structure disposed proximal to and radially inward from the circumferential perimeter of the lid. However, it will be readily appreciated that the sip hole may be located elsewhere on the container lid or of be fashioned in a different shape, without departing from the spirit of the present invention.

The term "stirrer" is used to generally refer to the device that may be used to plug the sip hole in a lid. In some embodiment, it is an optional requirement for the stirrer to be sized so as to be capable of stirring the liquid within the container. However, it is not an absolute requirement that the stirrer be capable of stirring the liquid in all instances. Similarly, it is not an absolute requirement that the stirrer be capable of plugging the sip hole in the lid. Rather, it is a preferred embodiment for the stirrer to be able to substantially plug the sip hole in a lid, and a further preferred embodiment for the stirrer to the capable of being used to stir the liquid in the container.

Briefly stated, the present invention is directed to a container (e.g., a coffee cup) with a lid containing a sip hole, which is an opening through which liquid inside the container may be dispensed. The present invention further comprises a stirrer, which as described herein is a device that may be used to removably plug the sip hole in the lid, so as to substantially prevent the flow of liquid through the sip hole when plugged. The stirrer is optionally further capable of stirring any liquid within the container, preferably when the container has such substantial amount of liquid therein so as to facilitate stirring. The present invention also may include an attachment mechanism or attachment means on or adjacent to the lid, whereby the stirrer may be releasably attached to the lid for storage, transportation, and to facilitate relocation of the stirrer.

Other features and advantages of the invention will be apparent from the following specification taken in conjunction with the following drawings.

BRIEF DESCRIPTION OF THE SEVERAL VIEWS OF THE DRAWINGS

The foregoing summary, as well as the following detailed description of a preferred embodiment of the container or cap assembly of the present invention, will be better understood when read in conjunction with the appended drawings. It should be understood, however, that the description is not limited to the precise arrangements and instrumentalities shown. In the drawings:

FIG. 1 is a top view and partial side elevational view of an embodiment of the present invention depicting a container lid with a stirrer attached thereto using a clip, wherein

FIG. 2 is another embodiment of the present invention depicting a container lid with a stirrer attached thereto using an abutment, wherein

FIG. 3 is another embodiment of the present invention wherein the stirrer has a longitudinal length that is greater than the axial circumference of the widest portion of the container lid, and wherein the stirrer is attached to the lid through grooves or abutments present on a raised outer circumferential portion of the lid, wherein

FIG. 4 is another perspective view of the embodiment of FIG. 3, presented in semi-transparency so as to look through the opaque surfaces of the embodiment, wherein

FIG. 5 is a further embodiment of the present invention wherein the stirrer may be attached to the lid in any of one or more positions corresponding with grooves or abutments on the lid surface, including wherein the stirrer is placed on or attached to the lid at a position that is along a chord of the substantially circular lid rather than along the diameter of the lid, wherein

Figure 1A:
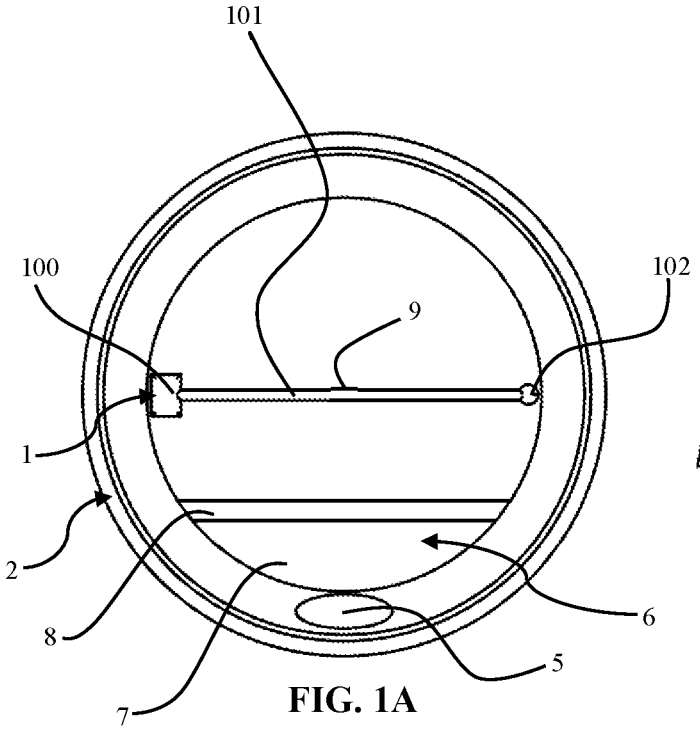
FIG. 1A and FIG. 1C are top views.
Figure 1B:
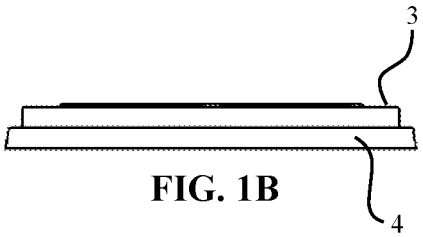
FIG. 1B and FIG. 1D are partial side elevational views, of the embodiment.
Figure 1D:
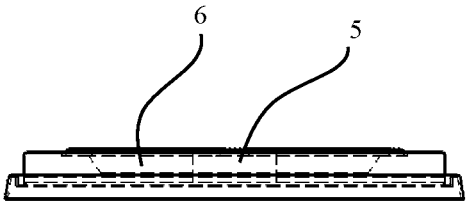

These and other embodiments will be further explained through the description below.

DETAILED DESCRIPTION OF THE INVENTION

While this invention is susceptible of embodiment in many different forms, there is shown in the drawings, and will herein be described in detail, non-exclusive preferred embodiments of the invention with the understanding that the present disclosure is to be considered as an exemplification of the principles of the invention and is not intended to limit the broad aspect of the invention to the embodiments illustrated.

Certain lids for containers are known in the beverage container industry. Some such lids and cooperating devices are described in the Background section of this disclosure, above. Coffee cup lids originated in the 1970*s* in response to the need for beverage container closure systems that allowed for the closure of beverage containers with some degree of protection from spilling the liquid contained therein, while also allowing for steam to escape, and for the liquid to be dispensed from and through the lid for consumption. Lids may be of any common design currently in use or previously developed, or other ornamental and functional designs for use with beverage cups.

In general terms, lids for single-use or disposable containers have three main components: a top portion comprising a top wall or surface; a mounting portion; and an opening. Typically, the mounting portion is adapted to engage an upper rim of the container to seal the lid on the container. The opening is adapted to permit the flow of the container's contents through the lid. While the present disclosure uses terms like "coffee cup lid" or "beverage container lid" to generally describe embodiments or elements of the present invention or what was known in the art, the present disclosure should be understood as directed more broadly to any type of fluid container closure system, including beverage container closure systems, which in turn include lids such as coffee cup lids and the like.

Turning to the figures, FIGS. 1 and 2 show various perspective views of embodiments of the invention that includes a lid substantially in the form of a pucker design. FIG. 1A shows a top view, and FIG. 1B shows a side elevational view, of an embodiment of the present invention, wherein the lid 2 comprises top portion 3, mounting portion 4, and opening 5. In the embodiments of FIG. 2A, the depicted lid 12 comprises top portion 13, mounting portion 14, and opening 15.

In some preferred embodiments of the present invention, the lid is of a "pucker" design, such that users may be required to drink through the lid rather than directly from the cup, as would be done in a peel or punch lid. An example of such a pucker-type lid is the Solo Traveler, designed by Jack Clements as exemplified, for example, in U.S. Pat. Nos. 4,589,569; 4,548,348; 4,615,495; and 5,523,042. In other preferred embodiments, the lid may have an attachment thereupon to facilitate a more natural drinking experience where drinking from an opening in the lid feels to the user more like drinking from a cup itself. For example, the sip hole may be positioned on a raised rim of the lid with a drinking basin or lowered portion radially inward from the raised rim, such that the user's upper lip may rest on or adjacent to the drinking basin or lowered portion, so as to provide a more ergonomic feel. Such a drinking basin or lowered portion of the lid may also provide the added advantage of being a catchment area for spilled beverage from within the cup, and may optionally have a small drainage hole allowing the liquid to flow back into the cup. In some embodiments, the drinking basin may take the form of an external trapezoidal well, wherein the contents of the beverage container may temporarily accumulate during the process of dispensing and/or drinking from the container. The presence of such a drinking basin may increase the olfactory sensation associate with drinking the beverage contained in the container, e.g., by allowing a beverage such as coffee to temporarily accumulate, aerate, and be exposed to the surrounding environment, en route to being drunk. Such a drinking basin may also help to cool the contents of the beverage container upon dispensing and lessen the chance that the user or drinker would get burned or scalded when drinking from the beverage container.

Examples of drinking basin consistent with embodiments of the present invention are shown in FIGS. 1 and 2. FIGS. 1A, 1C, and 1D show a drinking basin 6 comprised of at least two walls wherein the first wall 7 is substantially parallel to the top open surface of the beverage container or to the top portion 3 of the lid, and wherein the second wall 8 is positioned substantially obliquely to wall 7 wherein the angle between first wall 7 and second wall 8 may in some embodiments be greater than or equal to 90-degrees and preferably greater than 90-degrees. Similarly, FIGS. 2A, 2D and 2E show a drinking basin 16 comprised of at least two walls wherein the first wall 17 is substantially parallel to the top open surface of the beverage container or to the top portion 13 of the lid, and wherein the second wall 18 is positioned substantially obliquely to wall 17 wherein the angle between first wall 17 and second wall 18 may in some embodiments be greater than or equal to 90-degrees and preferably greater than 90-degrees. It can be appreciated that the drinking basin may comprise more than two walls and/or may have a curved surface rather than divided into walls, without departing from the present invention.

In other embodiments, the lid may comprise a raised ring-like portion with a lowered portion positioned radially inward from the raised ring-like portion. Exemplary embodiments of such lids are shown in FIGS. 3, 4, and 5. In FIG. 3, the top portion 33 comprises a ring-like raised portion 37 and a lowered inner portion 36. In such embodiments, the user may rest an upper lip substantially on the lowered inner portion when drinking directly from the opening 35. Similar structures may be seen in FIGS. 4 and 5.

In some embodiments, the raised ring-like structure may of a substantially uniform width. In other embodiments, the raised ring-like structure may vary in width around its circumferential extent. For example, the raised ring-like structure may have its widest width at or near the location of the sip hole, wherein the sip hole may optionally be located on the raised ring-like structure. The raised ring-like structure may be located abutting or substantially abutting the outer circumferential edge of the lid, or the raised ring-like structure may be located radially inward from the outer circumferentially edge of the lid, without departing from the spirit of the present invention.

The lid may be constructed of such materials that it is intended to be disposable or single-use. Such materials include plastics, wood, reinforced or waxed paper, and the like. The lid may also be constructed from more substantial material so as to be intended for reusable/multiple use. Such material for reusable use may optionally be dishwasher safe and constructed of a more durable design. The lid may be made of insulated materials or include other means of insulation such as double walls, integral dead space with air for insulation, heat reflective material, etc.

In some embodiments, the lid of the present invention may include a pressure equalization port, which may take the form of a puncture in the lid to allow the pressure within the cup the equalize with the pressure outside the cup when closed with the lid. An example of such a pressure equalization port or puncture is shown in FIGS. 3, 4, and 5, which contain puncture 38, 48, and 58, respectively.

In other embodiments, the pressure equalization system may be a set of two or more punctures or openings (e.g., one functioning as an intake and another as a vent) that may increase or substantially optimize airflow for a smoother drinking experience.

The lid may optionally be structurally reinforced such that it provides a firmer hold on the cup and/or a more rigid upper enclosure surface for the cup. Such reinforcement has the added benefit of allowing for the lid to be manufactured with less material, while still providing sufficient rigidity for on-the-go use. One non-limiting example of lid reinforcement is disclosed in U.S. Pat. No. 4,898,299 to David Herbst and Chris Boes, the disclosure of which is incorporated by reference. Other means of reinforcement such as baffles, grooves, ridges, veins, bars, or other support structures molded into the body of the lid may be used, preferably on the underside of the lid.

In some embodiments, the lid may include molded-in depressible sections that may be used as identifiers of the nature of the liquid contained in the container. As a non-limiting example, the lid may possess depressible circular sections that may be pushed in (or pushed out from the other side of the lid) that may have markings provided thereupon to indicate the nature of the liquid (for example, hot, cold, milk, sugar, etc.).

The present invention may include a stirrer for use in conjunction with the lid. The stirrer may be any device that is capable of stirring the beverage in the cup. In some embodiments, the stirrer has the benefit of functioning as both a stirrer and a stopper. When used as a stopper, the stirring stick fits into the sip hole of the lid to substantially prevent the flow of liquid through the sip hole. The sip hole may be any type of mouthpiece or pouring aperture present on the lid, or one or more such mouthpieces or pouring apertures, through which it is intended to dispense the liquid contained within the cup for drinking, mixing, etc. In some embodiments, the stirrer may be operatively coupled to the lid, such that in one mode the stirrer may be employed to stir the liquid inside the beverage container and in another mode the stirrer can be used to substantially plug the sip hole.

The stirrer may take the form of a rigid or semi-rigid structure. In some embodiments, the stirrer has three or more portions—a gripping portion at which a user may hold the stirrer for stirring the beverage or plugging the sip hole; a body portion which may be an elongated portion for stirring the beverage and/or extending through the sip hole when used as a plug; and a stirring end which may be coextensive with the body portion and similarly sized to the body portion, or may have larger axial dimensions or diameter than the body portion so as to create a resistance surface to enhance the stirring of the beverage. In some embodiments, the stirring end is appropriately sized such that it may pass through the sip hole present on the lid. In other embodiments, the stirring end may be shaped like a scoop or spoon to facilitate stirring, sipping, or scooping of materials into the beverage container.

Exemplary embodiments of such stirrers are shown in FIGS. 1-5. With reference to the stirrer of FIG. 1A, there is shown a stirrer 1 with gripping portion 100, body portion 101, and stirring end 102. Similarly, with reference to FIG. 3C, there is shown a stirrer 31 with gripping portion 200, body portion 201, and stirring portion 202.

In some embodiments, the body portion of the stirrer may be shaped an elongated portion like an tapering rod (of any cross-sectional shape) wherein the thinner end of the elongated portion is of such cross-sectional width or diameter so as to pass through the sip hole, while the thicker end of the elongated portion has a cross-sectional width or diameter that is too wide to pass through the sip hole (or too wide to pass through the sip hole without very significant physical force). As such, the elongated portion my be used to plug the sip hole be advancing the stirrer through the sip hole until substantial resistance is reached such that the stirrer plugs through sip hole through friction forces and/or the radially inward or compressive force on the stirrer from the lid, at the sip hole, thought to be caused by the deformation of the material of the lid at the sip hole.

In other embodiments, the stirrer may have disposed on it a plug-like protrusion that can engage with and substantially plug the sip hole. Such plug-like protrusion may preferably be located toward a longitudinal end of the body portion, or between the body portion and either the stirring portion or gripping portion, or integral to the stirring portion or the gripping portion.

In some embodiments, the stirrer may take the form of a substantially rigid structure with a longitudinal aperture disposed lengthwise along the stirrer, through which liquid can be sucked. The longitudinal aperture may optionally extend through the stirring end of the stirrer as well. In some embodiments, the stirrer may take the form of a drinking straw.

The body portion of the stirrer may have a variety of cross-sectional shapes suitable for attachment to the lid. Such cross-sectional shapes include but are not limited to circular, oval, elliptical, figure-of-eight, hour glass, triangular, square, rectangular, or any other type of polygonal shape including convex or non-convex polygons. In other embodiments, the body portion of the stirrer may have a cross-section that has both curved and straight or edged portions of its outer extend—for example, a flattened ellipse and/or a body portion in the shape of an elongated flattened rod. A non-limiting example of such a stirrer is shown in FIGS. 3-5. The stirrer is preferably shaped so as to facilitate coupling and/or attachment of the stirrer to the lid.

The stirrer may be of sufficient dimensions, particularly length, so as to effectively stir the beverage contained within the cup. In some embodiments, the stirrer is of length 4 cm to 13 cm, more preferably 4 cm to 10 cm, and even more preferably between 5 cm and 8 cm. In some embodiments, the stirrer is of length shorter than the diameter of the lid. In other embodiments, the stirrer is of length approximately equal to the diameter of the lid. In still other embodiments, the stirrer is of length shorter than the diameter of the lid. When stirrer is of length shorter than the diameter of the lid, preferred stirrer lengths are from 4 cm to 8 cm. When the stirrer is of length equal to or longer than the diameter of the lid, the preferred stirrer lengths are from 7 cm to 10 cm.

In some embodiments, the stirrer is sized so as to facilitate relatively easy manufacturing of the lid and stirrer. As a non-limiting example, the lid and stirrer may be manufactured as a single assembly or with a single mold from which the stirrer may be initially attached to the lid and then detachable by breaking the stirrer away from the lid or detaching the stirrer with force sufficient to permanently disengage one or more bonds that hold the stirrer to the lid.

In other embodiments, the lid may be provided to the end user with a stirrer affixed already inside the sipping hole (e.g., through the use of molded-in plastic tabs). In such embodiments, in order to engage with the sip hole and drink the beverage, the user would have to use force to detach the stirrer from the sip hole, take it out, and then affix it to the slots/tabs on the lid.

In some embodiments, the stirrer has one or more means of detachable attachment to the lid.

In some embodiments, the stirrer has at least two ways or means of detachable attachment to the lid, wherein the first attachment means is by inserting the stirrer into the sip hole such that there is a substantially firm attachment of the stirrer to the lid so as to substantially prevent the flow of liquid through the sip hole; and the second attachment means is a physical means present on, upon, or within the surface of the lid, such that the stirrer may be detachably attached to the lid when not being used to plug the sip hole.

Any known means of mechanical attachment may be used to releasably attach the stirrer to the lid. Such mechanical means include but are not limited to abutments, grooves, clips, levels, sliding means, hooks, adhesives, cantilevered structures, clasps, pins, etc.

In some preferred embodiments, the stirrer is attached to the lid by means of an abutment, as depicted, for example, in FIG. 2. Such an abutment generally comprises two raised portions with a groove therebetween for releasable affixation of the stirrer. As a non-limiting example, FIG. 2A shows an abutment 19, that is shown in an enlarged view in FIG. 2C, which depicts the abutment comprised of concentric raised portions 300 and 301 with the body portion of stirrer 9 passing laterally through the diameter or a chord of the abutment, which holds the stirrer in place on the top portion of the lid.

Figure 1C:
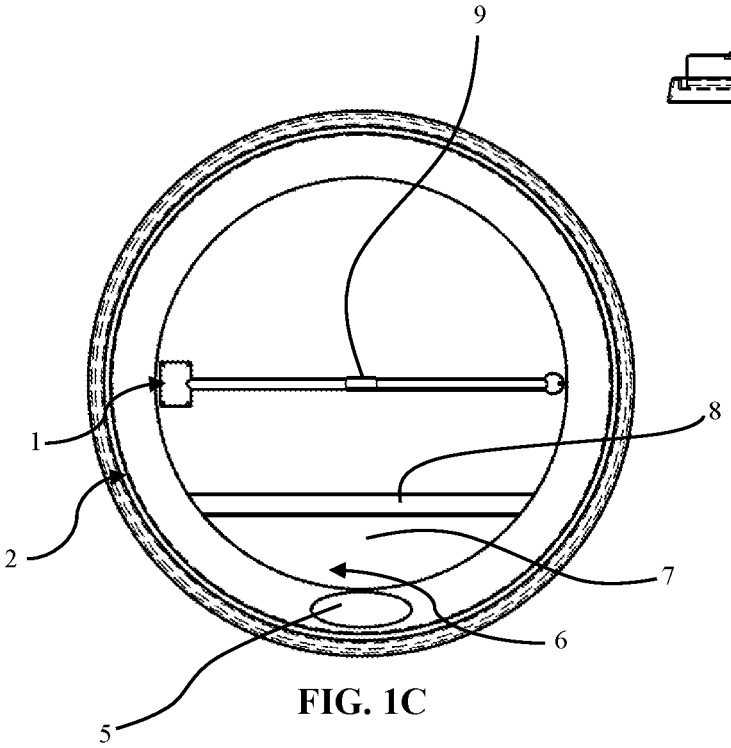
Figure 2A:
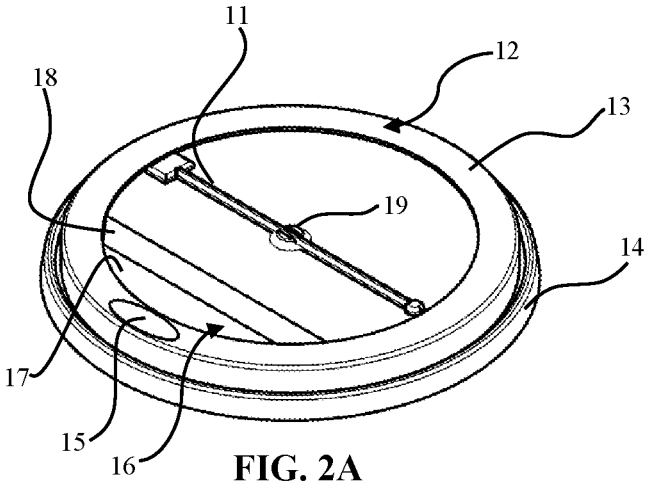
FIG. 2A and FIG. 2D are perspective views.
Figure 2B:
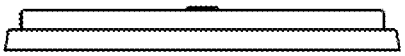
FIG. 2B and FIG. 2E are side elevational views, of the embodiment.
Figure 2C:
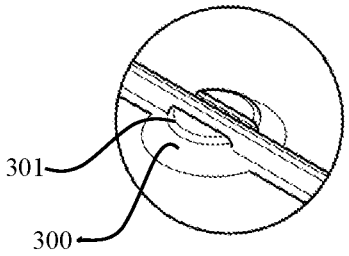
FIG. 2C is an enlarged view of the exemplary abutment.
Figure 2D:
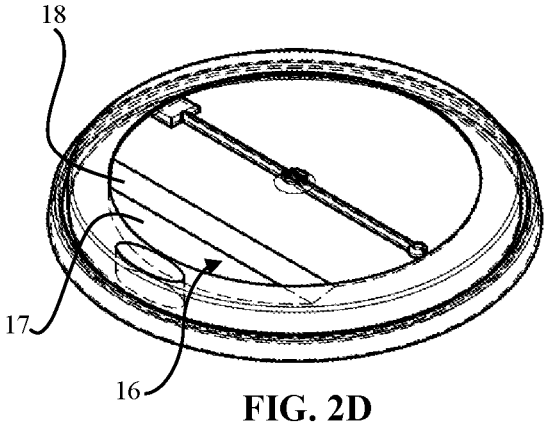
Figure 2E:
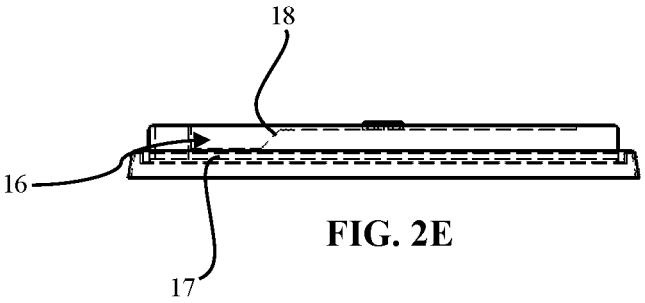
Figure 3A:
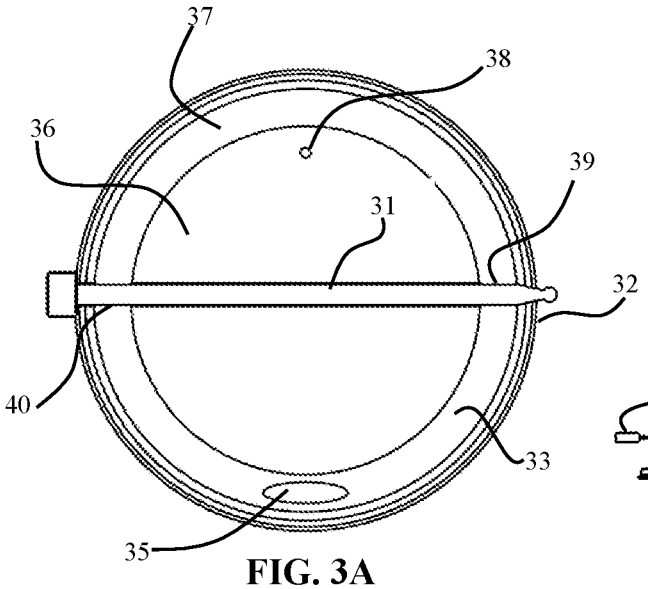
FIG. 3A is a top view.
Figure 3B:
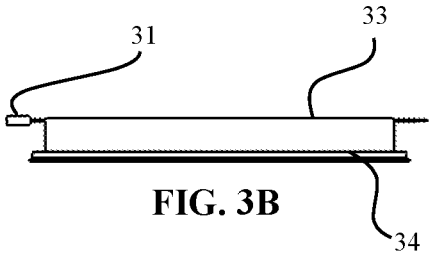
FIG. 3B and FIG. 3D are side elevational views.
Figure 3C:
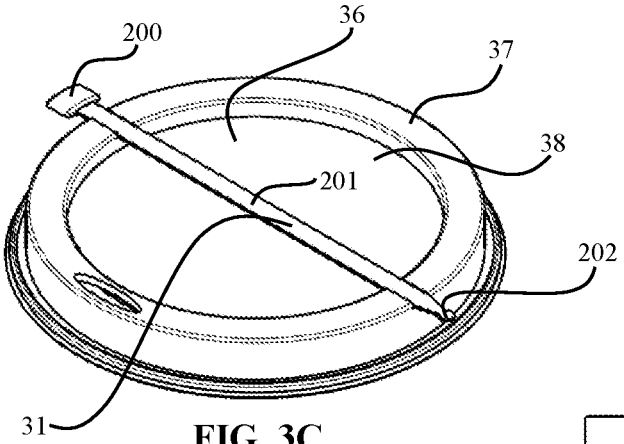
FIG. 3C is a perspective view.
Figure 3D:
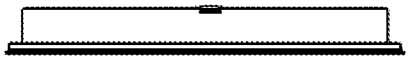
Figure 3E:
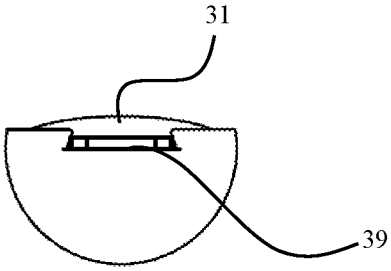
FIG. 3E is an enlarged cross-sectional view of an attachment of the stirrer to the lid through grooves or abutments, of the embodiment.
Figure 4A:
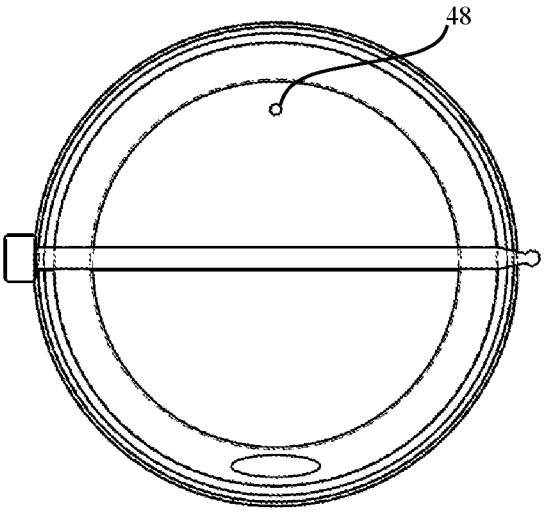
FIG. 4A is a top view.
Figure 4B:
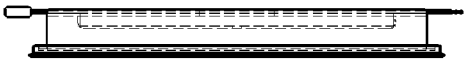
FIG. 4B and FIG. 4D are side elevational views.
Figure 4C:
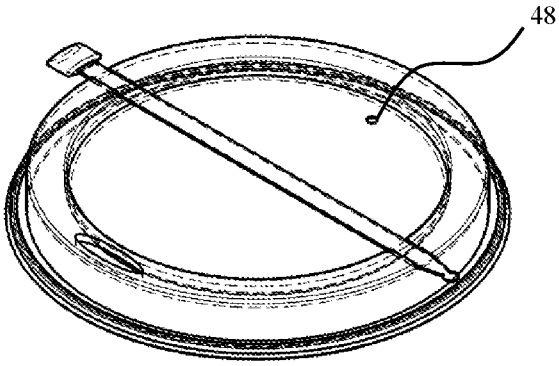
FIG. 4C is a perspective view.
Figure 4D:
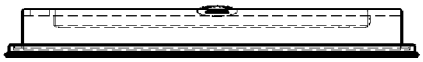
Figure 4E:
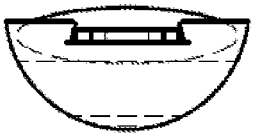
FIG. 4E is an enlarged cross-sectional view of an attachment of the stirrer to the lid through grooves or abutments, of the embodiment.
Figure 5A:
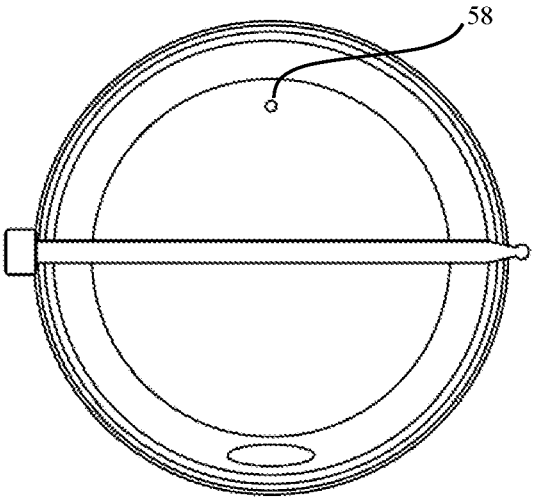
FIG. 5A is a top view.
Figure 5B:
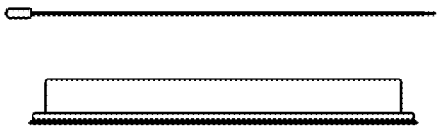
FIG. 5B and FIG. 5D are side elevational views.
Figure 5C:
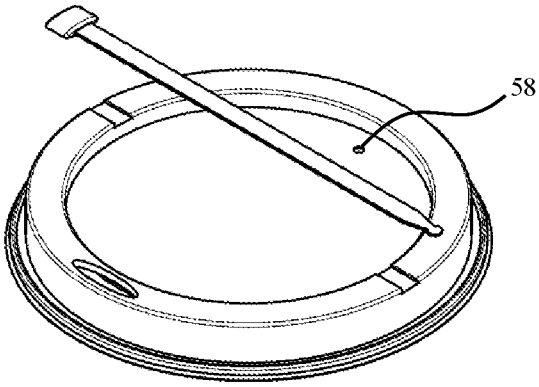
FIG. 5C is a perspective view.
Figure 5D:
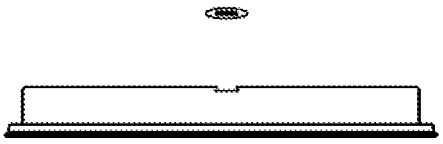
Figure 5E:
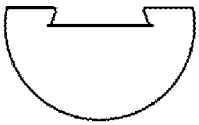
FIG. 5E is an enlarged cross-sectional view of an attachment of the stirrer to the lid through grooves or abutments, of the embodiment.

In other preferred embodiments, clips or similar mechanical means are used to attach the stirrer to the lid. As a non-limiting example, FIGS. 1A and 1C shows a clip 9 in the center of the top portion of the lid, positioned so as to engage the body portion 101 of the stirrer 1 when the stirrer is not being used to plug the hole or stir the beverage.

In other embodiments, the stirrer may be releasably attached to the lid using grooves or abutments along the upper surface of the lid and/or disposed upon a raised portion of the lid such as along a raised ring-like structure on the lid, non-limiting examples of which are disclosed in FIGS. 3-5. In FIG. 3A, there is shown a stirrer 31 position on or within grooves 39 and 40, which grooves are present on the outer ring-like portion 37 of the lid. It can be appreciated that the portion of the lid possession grooves need not be ring-shaped in order to practice embodiments of the present invention. FIG. 3E provides another view of the embodiment of FIG. 3, wherein the cross-sectional view of FIG. 3E shows the stirrer 31 positioned on or within or coupled to the groove 39. In embodiments consistent with FIG. 3E, the grooves may be of trapezoidal cross section such that the upper opening of the groove (disposed towards the top of the lid) is of lesser width than the bottom of the groove and/or lesser width than the width of the body portion of the stirrer such that the stirrer may be releasably attached to the lid when the stirrer is positioned within the groove.

In some preferred embodiments, the mechanical attachments means do not extend below the horizontal plane defining the lowest point or edge of the mounting portion of the lid. Optionally in these or other preferred embodiments, where the attachment means is a groove or channel, such groove or channel extends substantially through the entire diameter or along a chord of the top of the lid and/or through the raised ring-like portion of the lid (e.g., in FIGS. 3-5), such that the stirrer may be positioned thereupon. In some embodiments, the groove or channel extends both through the raised ring-like portion of the lid and also through the lowered middle portion of the lid. In preferred embodiments, the stirrer is releasably attached to the lid via the attachment means such that the stirrer is held substantially fixedly when attached to the lid via the attachment means. In other embodiments, the stirrer is held less firmly in a groove or other physical recess in a portion of the lid such that the stirrer may "rest" on the lid and remain on the lid through mild physical manipulation of the beverage container, but is not prevented from sliding off the lid or being separated from the lid due to gravity when the container is tilted at a steep angle or turned upside down.

In some embodiments, the cross-sectional shape of the body portion (which may be an elongated portion) of the stirrer may be selected so as to facilitate coupling and/or attachment of the stirrer to the lid. For example, a stirrer of circular, oval, or elliptical cross-section may be sized so that the cross-sectional diameter is marginally larger than the opening of the abutment or other attachment means on the lid, so as to facilitate holding of the stirrer on the lid.

In other embodiments where a stirrer of polygonal cross-sectional is selected, the attachment means on the lid may be shaped so as to operationally couple with the stirrer. For example, if the body portion of the stirrer in the shape of an elongated flattened rod, with a substantially rectangular cross-section, the lid may be provided with a groove shaped so as to operationally couple with the stirrer, such as a groove with an inverted-T-shaped cross-section. In such embodiments, the stirrer may be advanced through the opening of the groove on the lid and then turned on its side (roughly a 90-degree twist) at the bottom of the groove so as to interlock with the groove. The gripping portion and/or stirring end of the stirrer may be sized so as to be big enough to not pass in an axial direction through the groove on the lid, and thereby further help in attaching of the stirrer to the lid.

In some embodiments, the attachment means provides an audible or tactile signal, such as a click or pop, to indicate that the stirrer has been sufficiently attached to the lid so as to not be dislodged when a more substantial amount of force is applied. Such audible or tactile signals may be achieved using abutment(s) or groove(s) of dimensions smaller than those of the stirrer, or wherein the abutment(s) or groove(s) have a cross-section that is more than a semi-circle but less than a circle, such that the stirrer must "click" into place on the abutment(s) or groove(s).

In some embodiments, the stirrer is only detachable from the attachment means by force in a certain direction, such as, for example, in a direction substantially along the longitudinal axis of the stirrer.

In some other embodiments, components attached, adjacent, or integral to the lid may be used for attachment of the stirrer to the lid. Such components may include magnets, as may be more appropriate for re-usable containers rather than disposable containers, but may be used for either. Electrical or electrostatic means, such as powered by a battery or solar, may be used to facilitate releasable attachment of a stirrer to a lid.

In one embodiment, the stirrer is of such length as to extend up to or beyond both sides of the outer circumference of the lid. Non-limiting examples of such a stirrer are shown in FIGS. 3-5. In these and other embodiments, the attachment mechanisms may be present on the sides of the lid (i.e., disposed on or radially adjacent to the outer circumference of the lid or extending radially inward or adjacent to the outer circumference) and/or on the top-most surface area of the lid. In this and other embodiments, the stirrer may be detachably attached or coupled to the lid by clipping into the top side of the lid and/or securing the stirrer to the top side of the lid by pressing the stirrer down into pre-notched grooves.

In another embodiment, the stirrer is of length shorter than the diameter of the lid. In aspects of this embodiment, the stirrer may fit within the inner circumference of a raised ring-like portion of the upper surface of the lid and may be affixed to the lid through any know means of mechanical attachment. Non-limiting examples of such a stirrer are shown in FIGS. 1 and 2.

In some embodiments, the stirrer may be curved when initially attached to the lid and capable of being straightened out for use as a stirrer, then compressed or curved for reattachment. In other embodiments, the stirrer is a telescoping device that may be elongated or compressed in a longitudinal direction based on operative requirements. As would be understood, such a telescoping device may be more suitable for use in re-usable containers rather than in disposable containers due to manufacturing costs, but may be used in either type.

In some embodiments, the stirrer is held in place by a force sufficient to keep it attached to the lid when experiencing jolting forces as would be transferred to the cup when placed in a cup holder in a typical automobile.

The requirements for beverage containers such as coffee cups, especially of the disposable variety, are different from those for other containers such as lunch boxes or plastic containers (such as Tupperware). Disposable beverage containers are ubiquitous and pervasive, and must be manufactured in large quantities, transported easily with minimal volume occupied (such as by stacking) and easily dispensed. They are often used on-the-go, such as by consumers walking down city streets or driving in cars. As such, the attachment means that would be preferred for disposable beverage containers are different than for other containers, including that the attachment means should preferably not interfere with the stackability of the lids or containers during manufacturing, shipping, and storage, and the attachment means should preferably be appropriately sized to hold a stirrer and function so as to allow the stirrer to be stored, attached, and detached on-the-go, where the stirrer is sized so as to be capable of substantially plugging a sip hole in the lid and optionally capable of stirring liquid within the container.

The lid and the stirrer may be made of biodegradable materials, recyclable materials, compostable materials, and/or organic materials such as wood, coated wood, compressed leaves, and the like. Some users have a preference for such materials, which may be implemented in a market-specific way.

In some optional and alternate embodiments, the present invention may include one or more stickers that are provided with or upon the lid. Such stickers may be used, for example, to close the drink hole in the lid, and may be provided with sufficient adhesive of such material and character as to be reusable multiple times. In such embodiments, the sticker or stickers may have a position on the lid where the sticker is reattached to the lid for storage, so as to facilitate facile relocation of the sticker. For example, a sticker that is optionally for use with the present invention may be provided on a raised or lowered portion of the lid that is roughly in the shape of the sticker, and used to close the drink hole in the lid. In a further embodiment, the lid could include a detachable plug, wherein the plug may be stored on a portion of the lid that is shaped so as to receive the plug without blocking the drink hole, and the plug may also be used to plug over the drink hole. It may be appreciated that the plug could "press in" to the lid for its attachment, such as through the use of small perforations in the lid that are sized so as to receive small protrusions on the plug that are larger than the lid perforations.

It will be appreciated by those skilled in the art that changes could be made to the embodiments described above without departing from the broad inventive concept thereof. It is understood, therefore, that this invention is not limited to the particular embodiments disclosed, but is intended to cover modifications within the spirit and scope of the present invention as defined by the present disclosure.

I claim:

1. A container system comprising:

a. a container;

b. a lid for the container, said lid releasably attachable to the container, wherein the lid comprises a sip hole, and wherein the lid comprises a raised ring-like portion, and a lowered portion located radially inward from the raised ring-like portion;

c. a stirrer comprising an elongated body portion that is substantially rod shaped, and wherein the stirrer is releasably attached to the lid of the container; and d. wherein the lid further comprises attachment means, wherein the attachment means is located either only on the raised ring-like portion of the lid, on opposite ends of a diameter or chord of the raised ring-like portion and below the upper plane of the surface of the raised ring-like portion, or only on the lowered portion of the lid, wherein the stirrer is held substantially along or parallel to the surface of the lowered ring-like portion of the lid when engaged with the attachment means, and wherein the stirrer may be releasably attached to the lid through use of said attachment means, and the attachment means allows the stirrer to be completely detached from the lid and reattached to the lid.

2. The container system of claim 1, wherein the stirrer is capable of plugging the sip hole so as to prevent the flow of liquid from within the container through the sip hole.

3. The container system of claim 1, wherein the stirrer further comprises a gripping portion and a stirring end, wherein both the gripping portion and the stirring end have larger lateral dimensions than the body portion or have a larger lateral or radial diameter than the body portion.

4. The container system of claim 3, wherein the gripping portion of the stirrer is substantially flattened along the longitudinal axis of the stirrer.

5. The container system of claim 3, wherein the gripping portion of the stirrer is sized so as to plug the sip hole and thereby prevent the flow of liquid from within the container through the sip hole.

6. The container system of claim 3, wherein the stirrer further comprises a protrusion capable of engaging with and substantially plugging the sip hole on the lid, wherein the plug-like protrusion is located toward a longitudinal end of the body portion or integral to the gripping portion, and wherein the plug-like protrusion has a radial diameter greater than the radial diameter of the elongated body portion and the plug-like protrusion extends radially outward from the stirrer.

7. The container system of claim 1, wherein the attachment means is selected from the group consisting of abutments, grooves, channels, clips, levels, sliding means, hooks, adhesives, cantilevered structures, clasps, and pins.

8. The container system of claim 1, wherein the attachment means is selected from the group consisting of abutments, grooves, channels, and clips.

9. The container system of claim 1, wherein the top of the container is substantially open, and wherein the lid comprises a mounting portion that contacts the top of the container so as to removably affix the lid to the container.

10. The container system of claim 9, wherein the attachments means does not extend below the horizontal plane defining the lowest point or edge of the mounting portion of the lid.

11. The container system of claim 1, wherein the attachment means comprises an abutment, clip, or clasp, positioned substantially at the center of the lid.

12. The container system of claim 1, wherein the stirrer comprises a hollow interior disposed lengthwise along the major axis of the stirrer.

13. A container system comprising:

a. a container;

b. a lid for the container, said lid releasably attachable to the container, wherein the lid comprises an opening through which liquid optionally contained inside the container may be dispensed;

c. a device releasably attached to the lid of the container, said device comprising a gripping portion, a stirring end, and an elongated body portion longitudinally situated between the gripping portion and the stirring end, wherein the device is sized so as to be capable of preventing the flow of said liquid through said opening in the lid when the elongated portion of the stirrer is placed in and through said opening; and d. an attachment mechanism located on opposite ends of a diameter or chord of the lid, wherein the attachment mechanism does not project out past the upper surface of a raised ring-like portion, and wherein the attachment mechanism is configured for releasable attachment of the device to the lid.

14. The container of claim 1, wherein the stirrer is of length equal to or longer than the diameter of the lid.

15. The container of claim 1, wherein the stirrer does not substantially project above the upper plane of the lid when engaged with the attachment means.

16. The container of claim 1, wherein the attachment means is located only on the raised ring-like portion of the lid, and wherein the stirrer is substantially held above the lowered ring-like portion when the stirrer is engaged with the attachment means.

17. The container of claim 1, wherein the stirrer is of length equal to or smaller than the inner diameter of the raised ring-like portion of the lid.

18. A container system comprising:

a. a container;

b. a lid for the container, said lid releasably attachable to the container, wherein the lid comprises a sip hole;

c. a stirrer releasably attached to the lid of the container; and d. wherein the lid further comprises attachment means, wherein the attachment means comprises grooves or channels located on opposite ends of a diameter or chord of the lid and below the upper plane of the surface of a raised ring-like portion, and wherein the stirrer may be releasably attached to the lid through use of said attachment means, and the attachment means allows the stirrer to be completely detached from the lid and reattached to the lid.

19. The container of claim 1, wherein the attachment means is located only on the lowered portion of the lid, and wherein the attachment means is used to attach the stirrer to the lid when the stirrer is not in use for stirring.

* * * * *